US006360968B1

(12) United States Patent
Orrange et al.

(10) Patent No.: US 6,360,968 B1
(45) Date of Patent: Mar. 26, 2002

(54) WILDFIRE PROTECTION SYSTEM

(76) Inventors: Timothy Orrange, 902 McClintock St., Longwood, FL (US) 32750; Gary J. Sweeton, 1450 Shellmound Rd., Enterprise, FL (US) 32725

( * ) Notice: Subject to any disclaimer, the term of this patent is extended or adjusted under 35 U.S.C. 154(b) by 0 days.

(21) Appl. No.: 09/634,206

(22) Filed: Aug. 9, 2000

(51) Int. Cl.[7] ..... B05B 15/06

(52) U.S. Cl. ..... 239/273; 239/280; 239/208; 169/16; 169/54

(58) Field of Search ..... 239/273, 275, 239/280, 280.5, 281, 264, 207, 208, 209, 200, 251; 169/5, 13, 16, 37, 54

(56) References Cited

U.S. PATENT DOCUMENTS

| | | | | |
|---|---|---|---|---|
| 964,464 A | * | 7/1910 | Crawford-Frost | 169/16 |
| 1,285,236 A | | 11/1918 | Kohler | |
| 1,620,142 A | | 3/1927 | Thompson | |
| 1,831,880 A | | 11/1931 | Pierce | |
| 2,337,710 A | | 12/1943 | Cowan | |
| 2,678,845 A | | 5/1954 | Fitter | |
| 3,576,212 A | | 4/1971 | Siler | |
| 4,091,876 A | | 5/1978 | Valdatta | |
| 4,330,040 A | | 5/1982 | Ence et al. | |
| 4,824,020 A | | 4/1989 | Harward | |
| 5,263,543 A | | 11/1993 | Nigro | |
| 5,520,364 A | | 5/1996 | Bloxson et al. | |
| 6,109,361 A | * | 8/2000 | Henderson | 169/54 |

* cited by examiner

*Primary Examiner*—Lisa Ann Douglas
(74) *Attorney, Agent, or Firm*—Edward M. Livingston, Esq.

(57) ABSTRACT

A wildfire protection system has rotating sprinklers (1) on sprinkler legs (2) positioned temporarily or indefinitely as needed on roofs (10) with the sprinkler legs resting on opposite slopes (6) from a ridge (5) of the roof and removed for sprinkler irrigation or easily disassembled for compact storage when not in use for wildfire protection. The rotating sprinklers can wet not only roof tops but also nearby trees (13), shrubs (14) and areas for protection against flying sparks and burning particles. The rotating sprinklers are preferably a low-weight plastic type and the sprinkler legs are preferably four low-weight plastic members that intersect at a series connection for garden-hose water supply to one or more of the rotating sprinklers. The rotating sprinklers are saddled on a roof top with two of the sprinkler legs placed on each of two opposite roof slopes. Low weight of the rotating sprinklers allows them to be placed easily on roofs with access by ladder or structured to be positioned indefinitely. Anchor-weighting for extra resistance to winds if necessary can be provided by sandbags or by water containers (24) on sprinkler footings (4) with water supplied automatically from a garden water hose (16). The water containers can be removable and/or emptied easily and can have runner ends (25) contoured for sliding rooftop or irrigation transport. Backup supply of water can be provided from an available reservoir (17) with a pump (18) powered by a motor (20) or a heat engine (22) in a power system (19) that is protected from foreseeable wildfire.

31 Claims, 6 Drawing Sheets

WILDFIRE PROTECTION SYSTEM

BACKGROUND OF THE INVENTION

This invention relates to protection of buildings from wildfires with water sprinklers on roofs.

Damage and devastation from wildfires in natural-growth areas is a constant threat in many locations, particularly during dry seasons. Many homes and buildings are burned from direct contact with flames or most often from embers spewed from a wildfire that fall on the roofs of homes and buildings, sometimes a long distance from the fire. The present invention is designed primarily to protect homes and buildings from the latter occurrence.

Sprinkler protection from wildfires can range from known elaborate rooftop systems that affect aesthetics of a building and provide cooling also to simplicity of merely turning a hose on a building when a wildfire is imminent. The rooftop systems can be costly if no wildfire occurs and using the hose can be dangerous to the user, who must remain on sight in fear of a wildfire, and not sufficiently protective. The present invention is less expensive than the hose because it has other offsetting-use values and yet can be more effective than known elaborate rooftop systems. More particularly, it can be used not only as a highly effective rooftop system for wildfire production, but also as an advantageous and inexpensive on-ground sprinkler-irrigation system when not in use to protect against wildfires.

Examples of most-closely related known but yet different devices and systems are described in the following patent documents. U.S. Pat. No. 5,263,543, issued to Nigro on Nov. 23, 1993, taught a sprinkler system mounted on a roof permanently as a roof fixture instead of portable irrigation sprinklers on legs being positioned temporarily on roofs with the legs resting on opposite slopes of the roof as taught by this invention. U.S. Pat. No. 4,824,020, issued to Harward on Apr. 25, 1989, described a sprinkler stand on legs, but the legs are attached pivotally to a hub or table to be pivoted between parallel positions for being carried and angular positions for use with points of the legs being positioned in soil to arrest pivoting. This pivoting action and reliance on soil positioning prevents use on a rooftop where non-pivotal rigidity without reliance on soil positioning is essential. Further, Harward is limited to five legs, which would prevent its use on all but five-sided roofs which are unknown or conical roofs which are too few to render the Harward device practical within the teachings of this invention. U.S. Pat. No. 4,330,040, issued to Ence, et al. on May 18, 1982, described a fire preventing and cooling system with tubes having orifices permanently on rooftops for dispensing water differently than the legged positioning sprinkler system taught by Applicant. U.S. Pat. No. 4,091,876, issued to Valdatta on May 30, 1978, described fire sprinkler system for mobile homes having a loop of tubing mounted on the perimeter of their flat roofs with sprinklers pointed inwardly. U.S. Pat. No. 3,576,212, issued to Siler on Apr. 27, 1971, taught a fire-shielding device with sprinklers on stands positioned on ground surfaces and extended higher than a roof of a building for spraying water on the roof effectively.

SUMMARY OF THE INVENTION

Objects of patentable novelty and utility taught by this invention are to provide a wildfire protection system which:

- directs spray of water on rooftops and also on limited peripheral areas for fire protection;
- includes sprinklers on legs that rest reliably where positioned on roof slopes;

- can be positioned on a roof quickly when needed for wildfire protection;
- has series connection for a plurality of units to be positioned wherever needed on large and multi-sectioned roofs;
- has optionally sandbag-weighted or water-weighted bases for being carried and positioned easily and filled with water automatically when releasing water into a hose to which the sprinklers are connected;
- can be stored in disassembled mode for commercial distribution and for consumer storage when not in use and then assembled quickly and easily when needed;
- can be used as an effective irrigation sprinkler;
- is light enough to be easily carried on a ladder for positioning on a roof;
- can be produced inexpensively for low-cost but highly effective wildfire protection when needed; and
- optionally can be small, aesthetic and permanently weighted for indefinite positioning reliably on rooftops.

This invention accomplishes these and other objectives with a wildfire protection system having rotating sprinklers on sprinkler legs positioned temporarily or indefinitely as needed on roofs with the sprinkler legs resting on opposite slopes from a ridge of the roof and removed for sprinkler irrigation or easily disassembled for compact storage when not in use for wildfire protection. The rotating sprinklers can wet not only roof tops but also nearby trees, shrubs and areas for protection against flying sparks and burning particles against which tile roofs also are not protective. The rotating sprinklers are preferably a low-weight plastic type and the sprinkler legs are preferably four low-weight plastic members that intersect at a series connection for garden-hose water supply to one or more of the rotating sprinklers. The rotating sprinklers are saddled on a rooftop with two of the sprinkler legs placed on each of two opposite roof slopes. Low weight of the rotating sprinklers allows them to be placed easily on roofs with access by ladder or structured to be positioned indefinitely. Anchor-weighting for extra resistance to winds if necessary can be provided by sandbags or by water containers on sprinkler footings with water supplied automatically from a garden water hose. The water containers can be removable and/or emptied easily and can have runner ends contoured for sliding rooftop or irrigation transport. Backup supply of water can be provided from an available reservoir with a pump powered by a motor or a heat engine in a power system that is protected from foreseeable wildfire.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
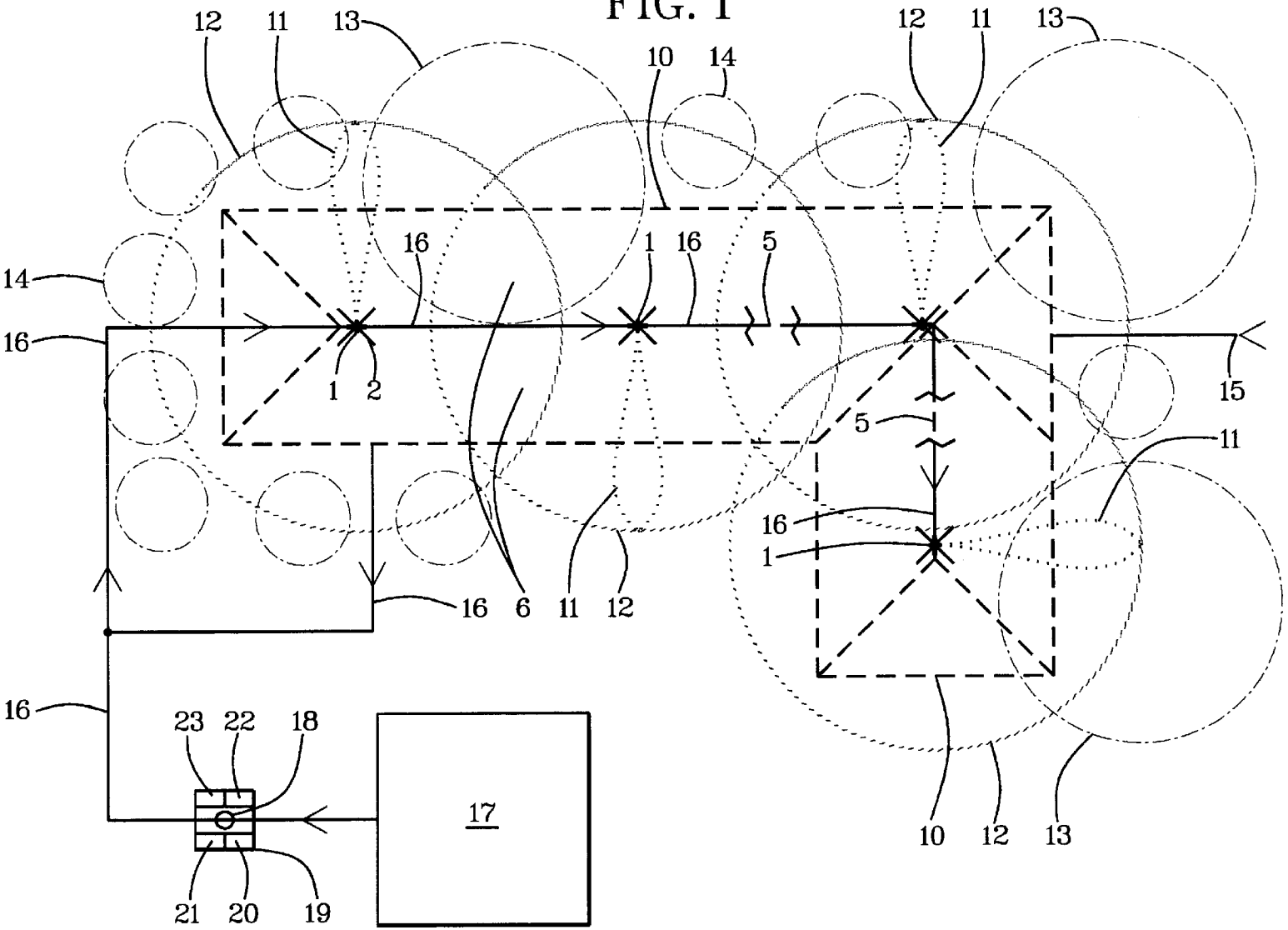
FIG. 1 is a layout view of the system.
Figure 2:
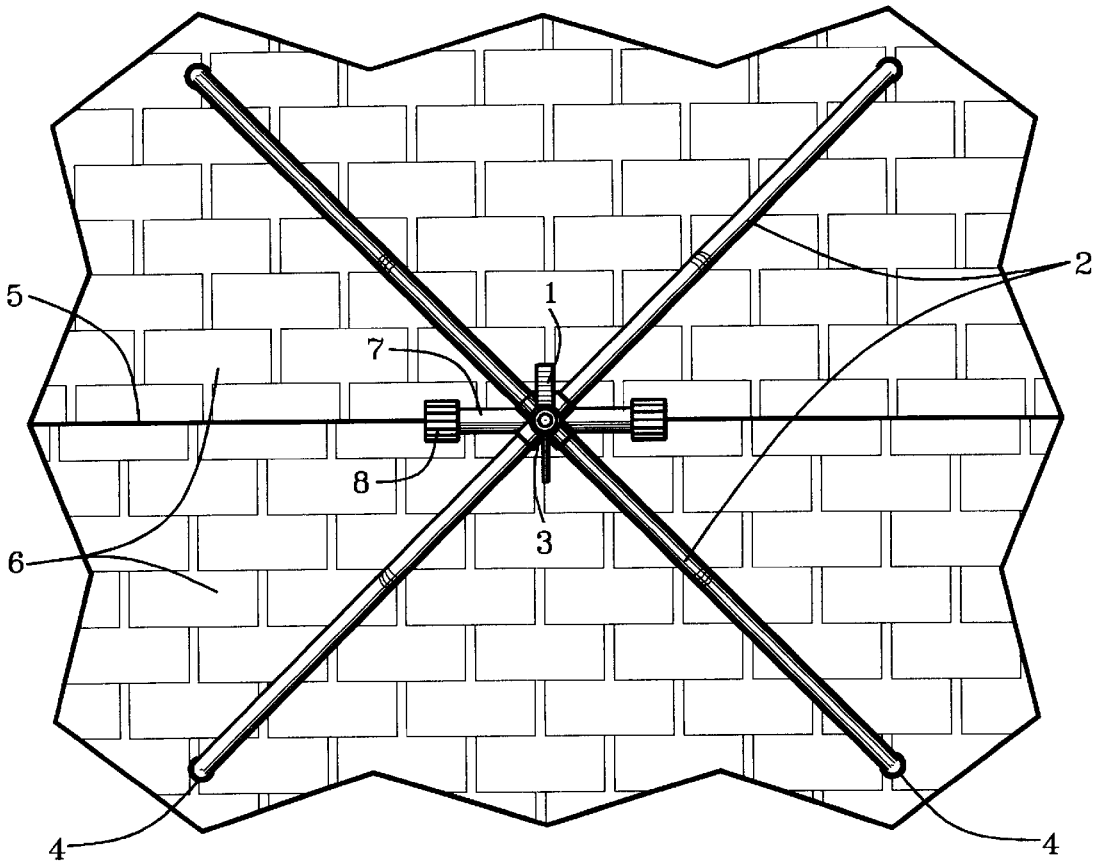
FIG. 2 is a top view of a four-legged rotating sprinkler shown on top of a portion of a rooftop.
Figure 3:
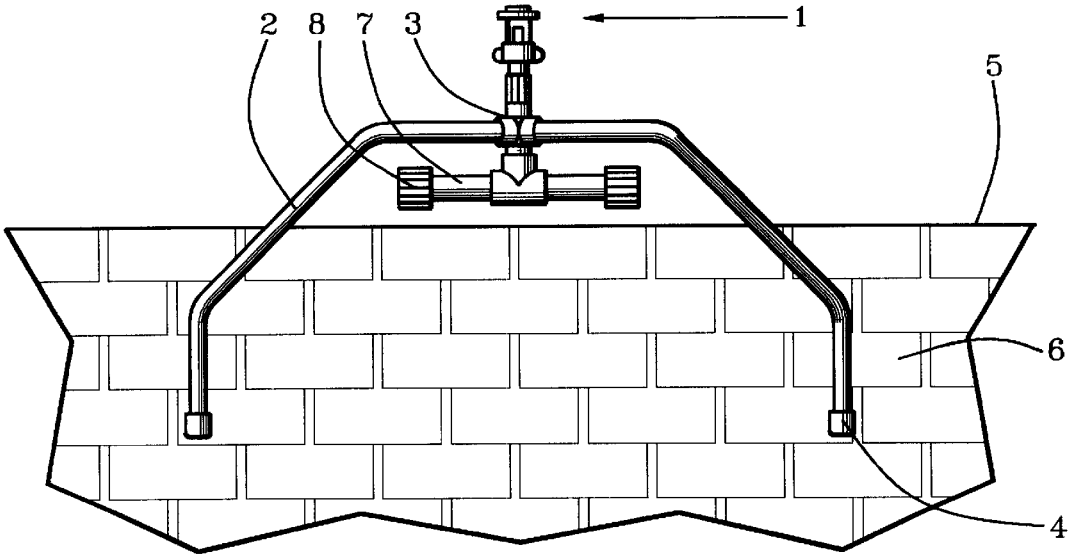
FIG. 3 is a side view of the FIG. 2 illustration.

Listed numerically below with reference to the drawings are terms used to describe features of this invention. These terms and numbers assigned to them designate the same features throughout this description.

| | |
|---|---|
| 1. | Rotating sprinkler |
| 2. | Sprinkler legs |
| 3. | Leg intersection |
| 4. | Sprinkler footings |
| 5. | Ridge |
| 6. | Slope |
| 7. | Water-inlet tube |
| 8. | Water-hose connection |
| 9. | Water conveyance |
| 10. | Roof |
| 11. | Water spray |
| 12. | Circular wet areas |
| 13. | Trees |
| 14. | Shrubs |
| 15. | Community water-supply system |
| 16. | Water hose |
| 17. | Reservoir |
| 18. | Pump |
| 19. | Power system |
| 20. | Motor |
| 21. | Battery |
| 22. | Heat engine |
| 23. | Engine fuel |
| 24. | Water containers |
| 25. | Runner ends |
| 26. | Straight-wall sleeves |
| 27. | Tapered-wall sleeves |
| 28. | Lock-pin orifices |
| 29. | Lock pins |
| 30. | Lock slots |
| 31. | Connection plug |
| 32. | Anchor-water conveyance |
| 33. | Water-conveyance orifice |

Referring first to FIGS. 1–5, a rotating sprinkler 1 has a plurality of sprinkler legs 2 extended rigidly outward radially from a leg intersection 3 and directed arcuately downward to sprinkler footings 4 on distal ends of the sprinkler legs 2 for positioning the rotating sprinkler 1 vertically above a ridge 5 of a roof with the sprinkler footings 4 on slopes 6 of the roof at distances apart for providing leverage of the sprinkler legs 2 to resist predetermined wind pressure. The rotating sprinkler 1 is positioned proximate the leg intersection 3. A water-inlet tube 7 having at least one water-hose connection 8 is attached to a bottom of the rotating sprinkler 1. The rotating sprinkler 1 includes a water conveyance 9 in fluid communication intermediate the water-inlet tube 7 and the rotating sprinkler 1.

In one preferred embodiment, the rotating sprinkler 1, the sprinkler legs 2, the leg intersection 3, the sprinkler footings 4, the water-inlet tube 7, the water-hose connection 8 and the water conveyance 9 assembled have light-weight construction for being lifted and placed on the ridge 5 of a rooftop.

In another preferred embodiment, the rotating sprinkler 1, the sprinkler legs 2, the leg intersection 3, the sprinkler footings 4, the water-inlet tube 7, the water-hose connection 8 and the water conveyance 9 assembled are more compact, optionally heavier per size but still light weight totally. They can have weighted sprinkler footings 4 which are structured to be either left on a rooftop indefinitely or temporarily and can be blended into building design and aesthetics. For this embodiment, higher density bust smaller steel and plastic structure can be employed.

Shown in the system layout view of FIG. 1, a roof 10 in dashed lines with a conventional L-shape has a plurality of rotating sprinklers 1 from which water spray 11 in dotted lines sprays water on circular wet areas 12 in dotted lines to drench portions of trees 13 and shrubs 14 in dot-dash lines in addition to parts of the roof 10. Pressurized water is directed from a pressurized-water system such as a community water-supply system 15 from which a water hose 16 from a house gets water to direct to the rotating sprinklers 1. Optionally as a backup, the pressurized-water system includes a reservoir 17 with water pressurization by a pump 18 having a power system 19 that is isolated from interruption by a wildfire. The pump 18 can be electrically powered with a motor 20 and the power system 19 can include a battery 21. Additionally optional, the pump 18 can be heat-engine powered with a heat engine 22 having engine fuel 23 in the power system 19.

Figure 7:
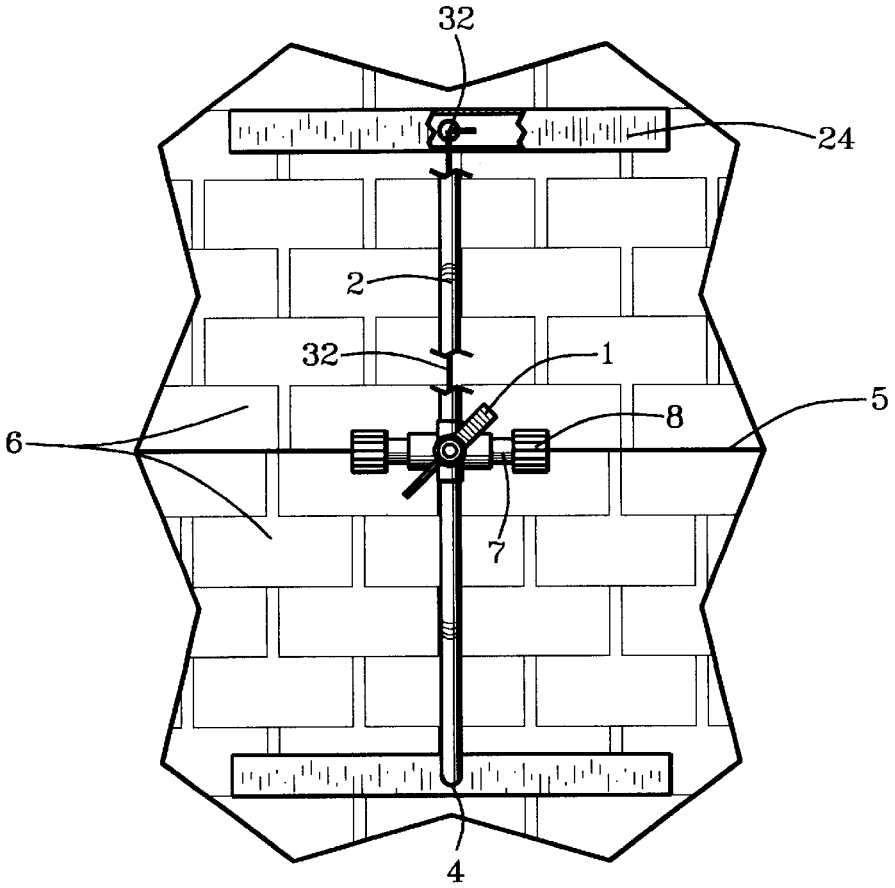
FIG. 7 is a partially cutaway top view of a two-legged rotating sprinkler having a tube to a water container for anchoring the sprinkler legs to a rooftop by using water from the water-inlet tube.
Figure 8:
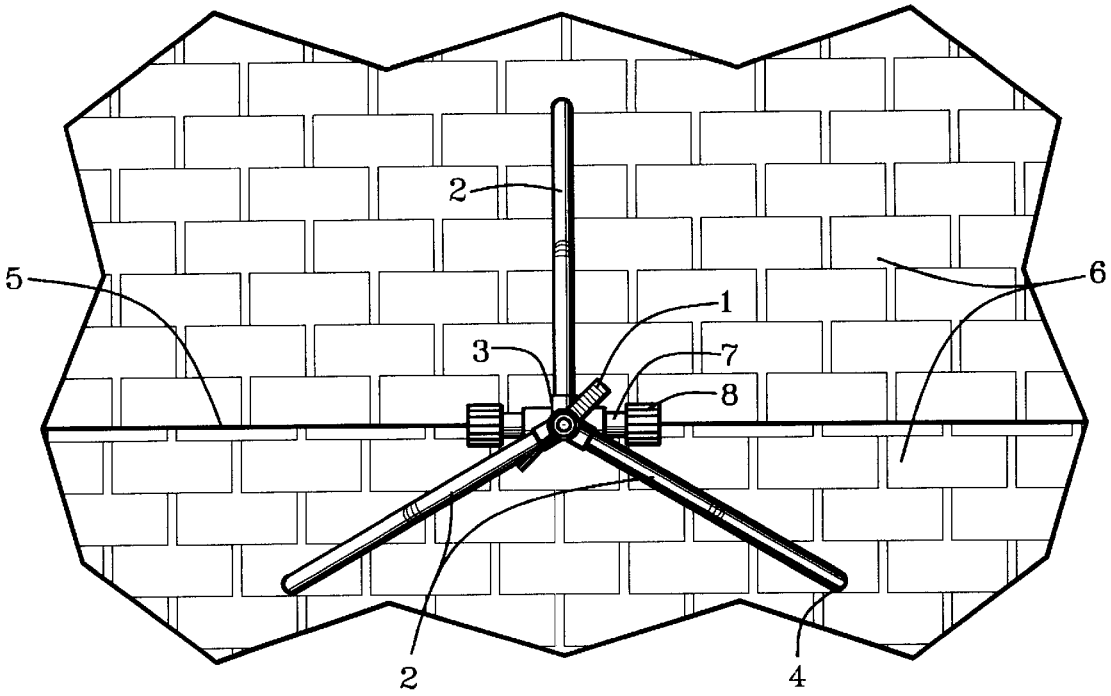
FIG. 8 is a top view of a three-legged rotating sprinkler on a portion of a rooftop.
Figure 9:
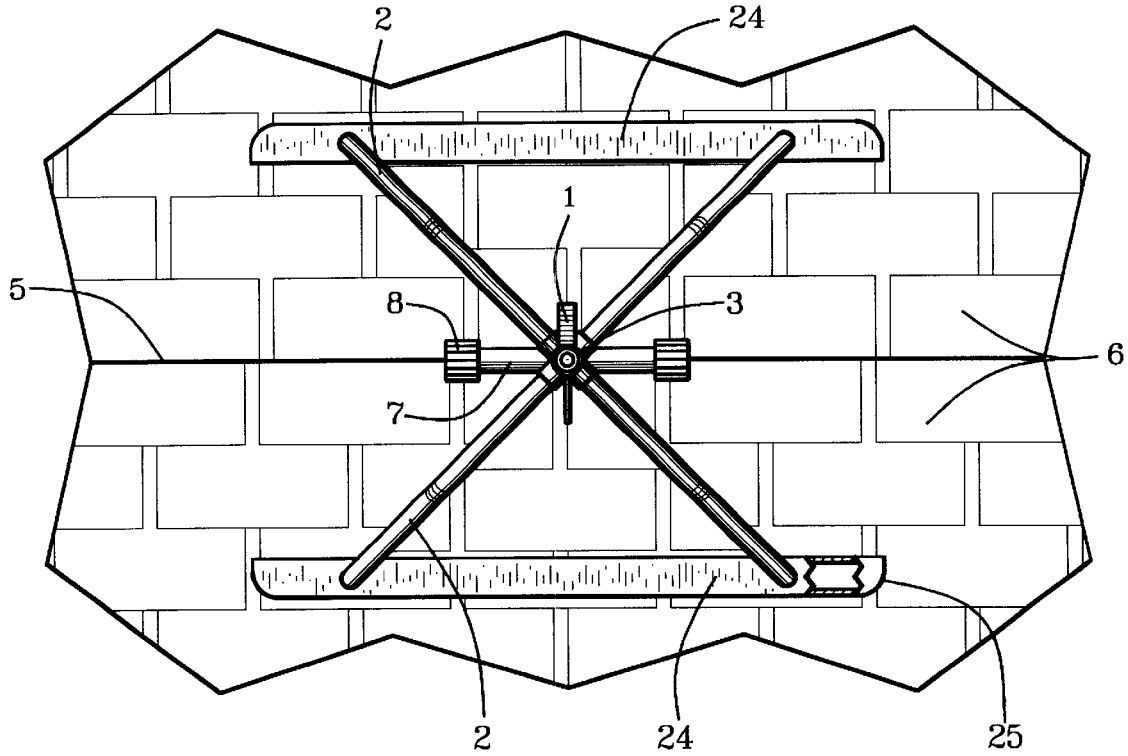
FIG. 9 is a partially cutaway top view of a four-legged rotating sprinkler anchored with water containers on a portion of a rooftop.

The plurality of sprinkler legs 2 is preferably four as depicted in FIGS. 1–3, and 9, but can be three as depicted in FIG. 8, two as depicted in FIG. 7, or other plurality. For use of two sprinkler legs 2 shown in FIG. 7, the sprinkler footings 4 can include anchoring bases such as water containers 24 that can be used also with four sprinkler legs 2 as shown in FIG. 9.

Anchoring bases such as the water containers 24 shown in FIGS. 7 and 9 can have runner ends 25 like a ski, a sleigh runner or a boat bow depicted in FIG. 9 for being slid along slopes 6 of roofs 10 or for being slid along ground surfaces when being used for sprinkler irrigation. The water containers 24 can be emptied of water for being slid or otherwise positioned and then filled.

Anchoring bases can be permanently weighted but similarly shaped and structured with suitably heavy material instead of being water containers 24 shown in FIGS. 7 and 9. This is particularly suitable for weighted sprinkler footings 4 which can be smaller based and structured to be left on a roof 10 indefinitely.

Figure 5:
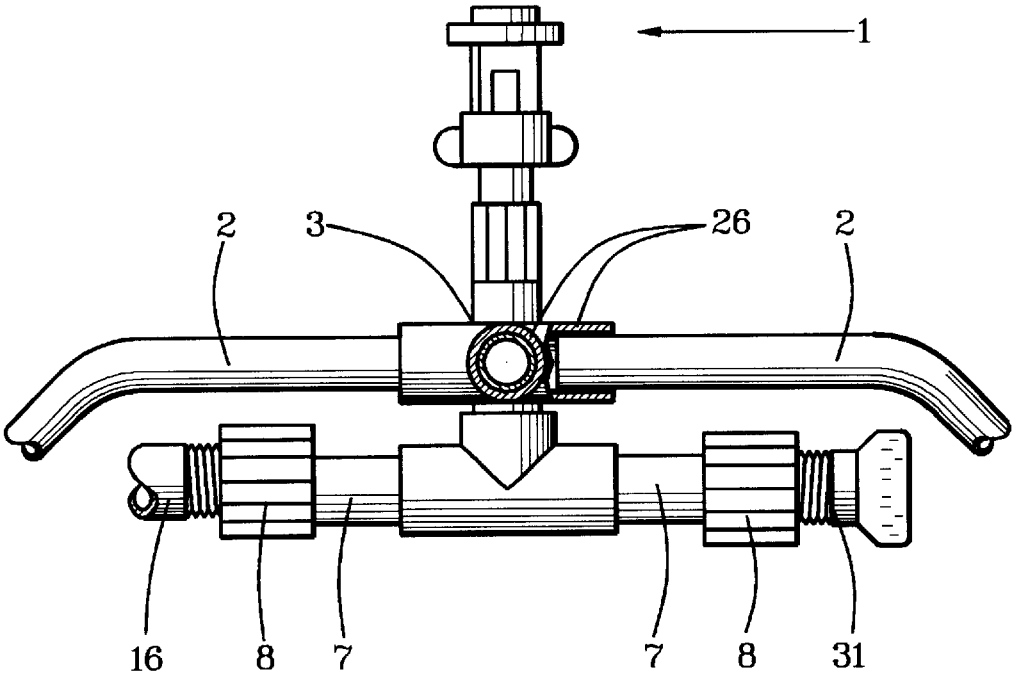
FIG. 5 is a partially cutaway side view of a leg intersection having a straight-walled-sleeve connection for sprinkler legs.
Figure 6:
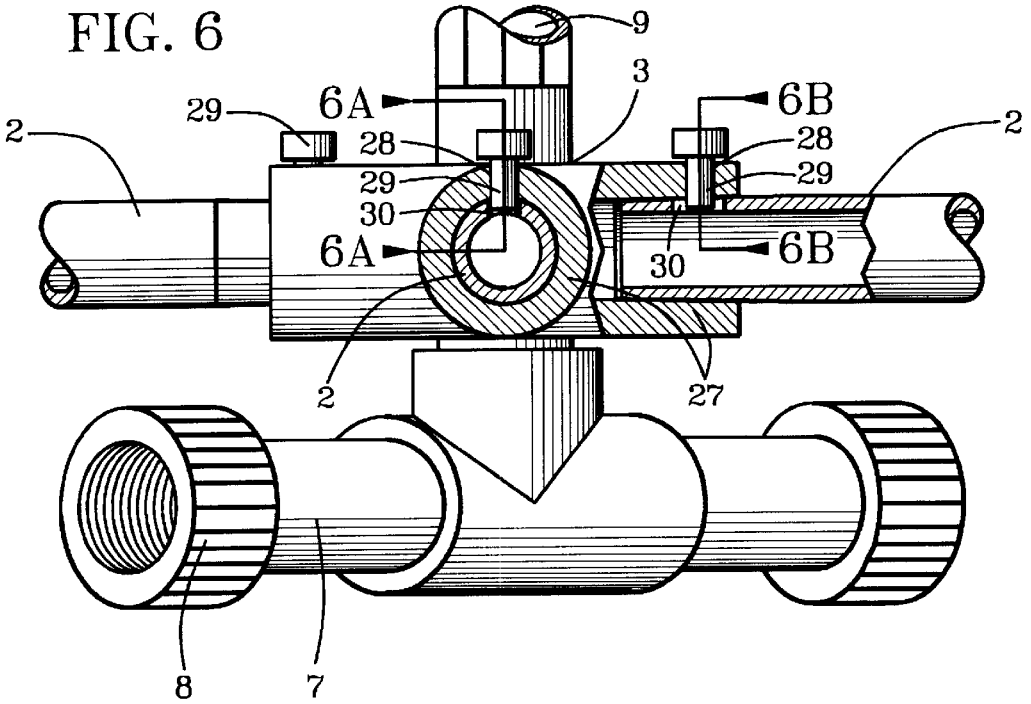
FIG. 6 is a partially cutaway side view of a sprinkler-leg intersection having tapered sleeves and lock pins for securing the sprinkler legs to the sprinkler intersection.
Figure 10:
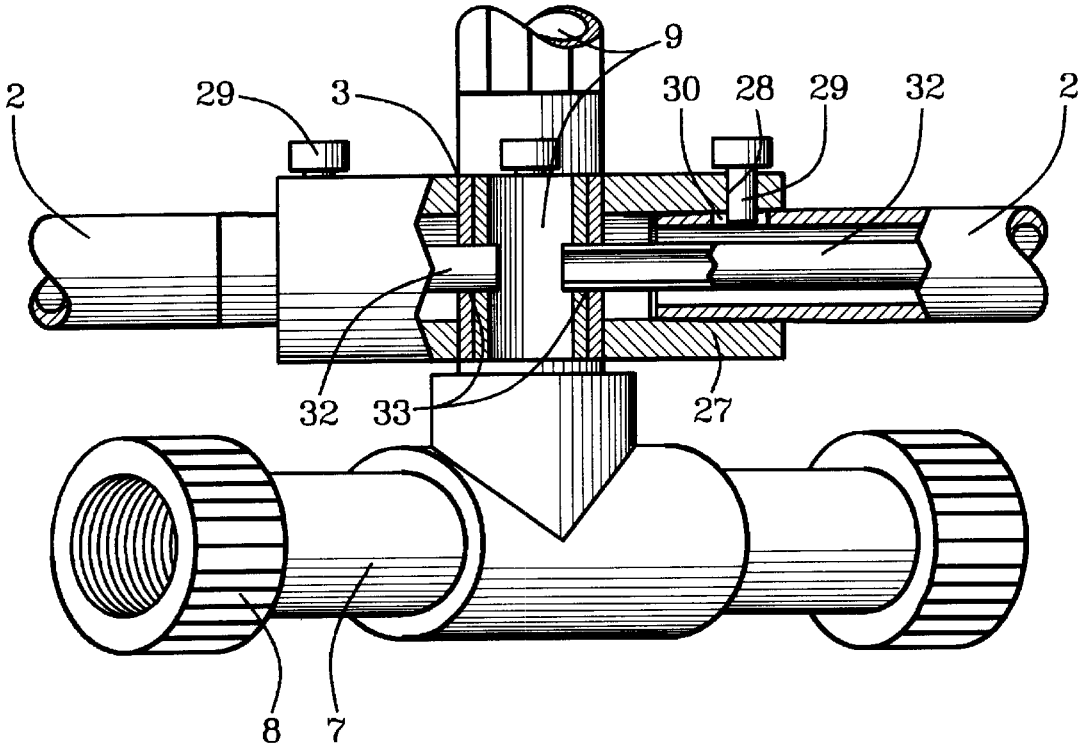
FIG. 10 is a partially cutaway side view of a fixed sprinkler intersection having tapered sleeves, lock pins for securing four sprinkler legs to the sprinkler intersection and tubes for conveying water from the rotating sprinkler to the water containers for anchoring weight.
Figure 11:
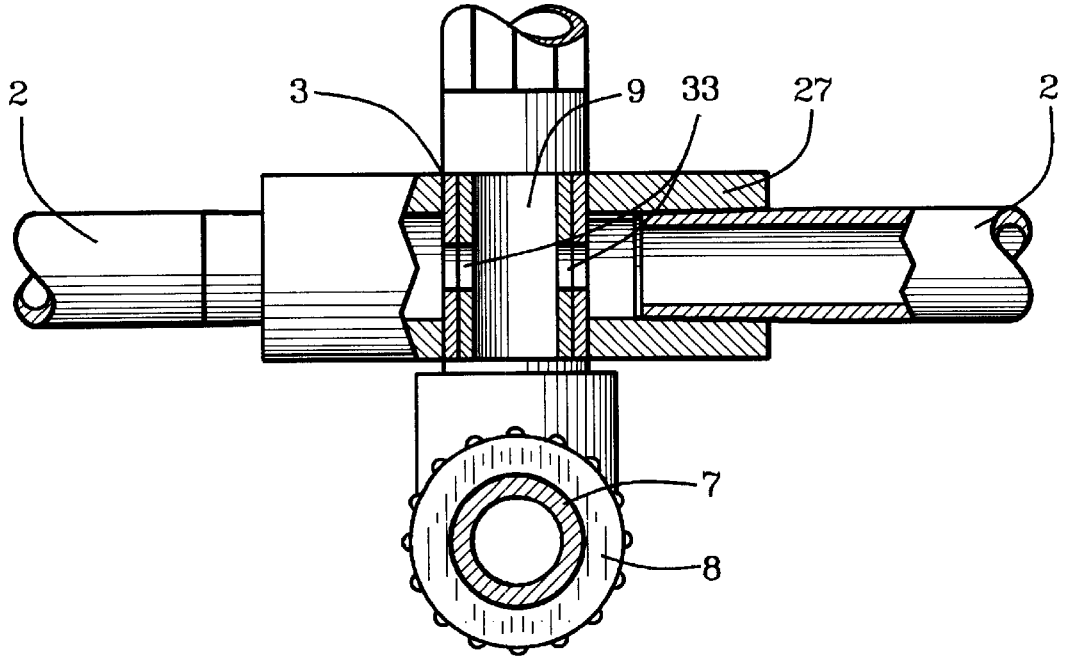
FIG. 11 is a partially cutaway side view of a fixed sprinkler intersection having tapered sleeves for attachment of sprinkler legs that convey water to water containers.

Referring further to FIGS. 5–6 and 10–11, the sprinkler legs 2 are preferably tubular members with either straight-wall ends to be received by leg-attachment sleeves which are straight-wall sleeves 26 of the leg intersection 3 as shown in FIG. 5, or tapered ends to be received by tapered-wall sleeves 27 as shown in FIGS. 6 and 10–11. Whether straight-wall sleeves 26 or tapered-wall sleeves 27, the leg intersections 3 can have leg attachments with rotation resistors for quick, rigid and rotation-resistant attachment of the sprinkler legs 2 to the leg intersections 3. The rotation resistors preferably include lock-pin orifices 28 for receiving lock pins 29. Top ends of the sprinkler legs 2 have lock slots 30 for receiving the lock pins 29.

The lock pins 29 are positioned in the lock-pin orifices 28 without being extended into the lock slots 30 for allowing insertion of the tops of the sprinkler legs 2 into the tapered-wall sleeves 27, for allowing rotation of the tops of the sprinkler legs 2 in the tapered-wall sleeves 27 and for allowing removal of the tops of the sprinkler legs 2 from the tapered-wall sleeves 27. The lock pins 29 are extended into the lock slots 30 for preventing the top ends of the sprinkler legs 2 from being rotated in, loosened from and removed from the tapered-wall sleeves 27 or from the straight-wall sleeves 26.

The lock slots 30 preferably have a circumferential width to receive the lock pins 29 snugly and a linear length to receive the lock pins 29 at predetermined distances of insertion of the tops of the sprinkler legs 2 into either the straight-wall sleeve 26 or into the tapered-wall sleeve 27 as illustrated. Prevention of rotation resists loosening and removal of the sprinkler legs 2. The lock pin 29 can be a set screw that is screwed into or slide-pressed into the lock-pin orifice 28. The set screw can be attached proximate the leg intersection 3 with a strap or line to prevent losing it when removed.

Permanent or indefinite attachment of the sprinkler legs 2 to the leg intersection 3 for embodiments intended for indefinite positioning on roofs 10 can have similar structure as for quick assembly and disassembly for temporary positioning on the roofs 10. An added feature for indefinite positioning can be addition of a suitable adhesive on the top end of the sprinkler legs 2 before insertion into the straight-wall sleeve 26 or into the tapered-wall sleeve 27.

Figure 4:
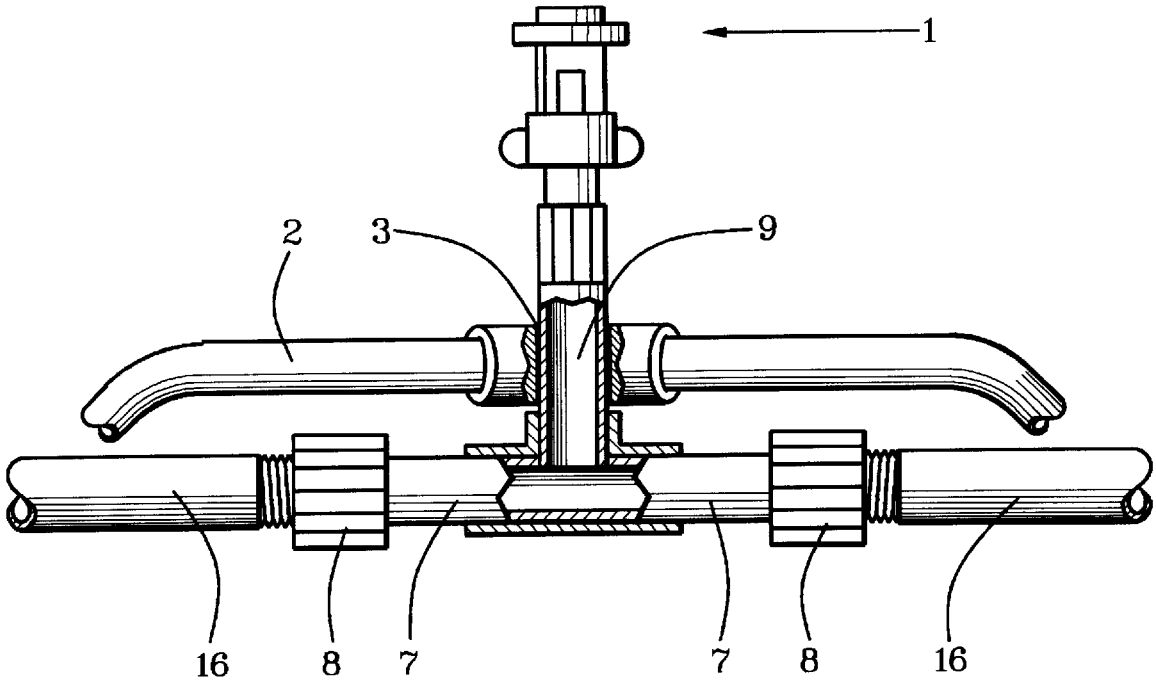
FIG. 4 is a partially cutaway side view of a rotating sprinkler having a water conveyance from a water-inlet tube.

The water-inlet tube 7 can be double-ended as shown with a water-hose connection 8 on both ends for multiple or series use of the rotating sprinkler 1 with a water hose 16 connected between them as shown in FIGS. 1 and 4. For series-end rotating sprinklers 1 and optionally for single rotating sprinklers 1, a terminal end of the water-inlet tube 7 can have a cap that can be screwed onto it or the water-hose connection 8 on the terminal end of the water-inlet tube 7 can have a connection plug 31 screwed into the water-hose connection 8 in place of the water hose 16 as shown in FIG. 5.

Referring further to FIGS. 7, and 9–11, the water containers 24 employed for anchoring bases can be filled automatically from the water conveyance 9 through anchor-water conveyances 32 as depicted in FIGS. 7 and 10 or directly through the sprinkler legs 2 as depicted in FIG. 11 by direction of water into the water-inlet tube 7. A water-conveyance orifice 33 in the water conveyance 9 is provided for either the anchor-water conveyances 32 or for direct conveyance through the sprinkler legs 2. Direct conveyance through the sprinkler legs 2 requires high-strength and leakproof connection of the tops of the sprinkler legs 2 to the leg intersection 3. For either direct or separately tubular conveyance of water from the water conveyance 9, rigid, non-rotational and leakproof connection of the water conveyance 9 to the leg intersection 3 is provided. An easy-empty outlet from the water containers 24 can be provided for non-use or irrigation-use modes.

A new and useful wildfire protection system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A wildfire protection system comprising:

at least one rotating sprinkler on a plurality of sprinkler legs;

the plurality of sprinkler legs being extended rigidly outward radially from a leg intersection and directed arcuately downward to sprinkler footings on distal ends of the sprinkler legs for positioning the rotating sprinkler vertically above a ridge of a roof with the sprinkler footings on slopes of the roof at distances apart for providing leverage of the sprinkler legs to resist predetermined wind pressure;

the rotating sprinkler being positioned proximate the leg intersection;

a water-inlet tube attached to a bottom of the rotating sprinkler;

the water-inlet tube having at least one water-hose connection;

the rotating sprinkler including a water conveyance in fluid communication intermediate the water-inlet tube and the rotating sprinkler; and the rotating sprinkler, the sprinkler legs, the sprinkler footings, the water-inlet tube, the water-hose connection, and the water conveyance assembled having light-weight construction suitable for being lifted and placed on a rooftop.

2. The wildfire protection system of claim 1, wherein:

the plurality of the sprinkler legs is four; and the sprinkler footings are about two-to-three feet apart and about one-to-two feet vertically below the leg intersection.

3. The wildfire protection system of claim 1, wherein:

the plurality of the sprinkler legs is three; and the sprinkler footings are about three-to-four feet apart and about two-to-three feet vertically below the leg intersection.

4. The wildfire protection system of claim 1, wherein:

the rotating sprinkler includes light-weight plastic structure.

5. The wildfire protection system of claim 1, wherein:

the rotating sprinkler includes light-weight aluminum structure.

6. The wildfire protection system of claim 1, wherein:

the rotating sprinkler includes light-weight structure with thin-walled high-tensile stainless steel.

7. The wildfire protection system of claim 1, wherein:

the sprinkler legs are tubular members with thin walls for reliable positioning of the rotating sprinkler in opposition to predetermined storm pressures with predetermined material for structure of the sprinkler legs.

8. The wildfire protection system of claim 1, wherein:

the leg intersections have leg-attachment sleeves for receiving top ends of the sprinkler legs.

9. The wildfire protection system of claim 1, wherein:

the leg intersections have leg attachments with rotation resistors for quick, rigid and rotation-resistant attachment of the sprinkler legs to the leg intersections.

10. The wildfire protection system of claim 9, wherein:

the leg attachments include tapered sleeves having inside-peripheral taper in the leg intersections for receiving top ends of the sprinkler legs;

the tapered sleeves have lock-pin orifices for receiving lock pins;

the top ends of the sprinkler legs have lock slots for receiving the lock pins;

the lock pins are positioned in the lock-pin orifices without being extended into the lock slots for allowing insertion of the tops of the sprinkler legs into the tapered sleeves, for allowing rotation of the tops of the sprinkler legs in the tapered sleeves and for allowing removal of the tops of the sprinkler legs from the tapered sleeves; and the lock pins are extended into the lock slots for preventing the top ends of the sprinkler legs from being rotated in, loosened from and removed from the tapered sleeves selectively.

11. The wildfire protection system of claim 1, wherein:

the water-inlet tube is double-ended with a first water-hose connection on a first end and a second water-hose connection on a second end for optionally series use of a plurality of the rotating sprinklers with water hoses.

12. The wildfire protection system of claim 1, wherein:

the sprinkler footings are soft for preventing damage to rooftops.

13. The wildfire protection system of claim 12, wherein:

the sprinkler footings have rigid structure and tensile strength for holding attached weights.

14. The wildfire protection system of claim 12, wherein:

the sprinkler footings have weight attachments for attachment of sandbags for anchoring weights.

15. The wildfire protection system of claim 1, wherein:

the sprinkler footings have water containers to contain water for anchoring bases.

16. The wildfire protection system of claim 15 and further comprising:

anchor-water conveyances intermediate the water-inlet tube and the water containers for filling the water containers simultaneously with directing water to the rotating sprinkler after being positioned on a rooftop.

17. The wildfire protection system of claim 16, wherein:

the water containers have runner ends for being drug empty or filled when being used for sprinkler irrigation; and the water containers have broad, non-scratch roof-contact surfaces.

18. The wildfire protection system of claim 1 and further comprising:

a water hose attachable in fluid communication intermediate the water-inlet tube and a pressurized-water source.

19. The wildfire protection system of claim 18, wherein:

the pressurized-water source includes a community water-supply system.

20. The wildfire protection system of claim 19, wherein:

the pressurized-water system includes a reservoir of water in fluid communication from the reservoir to the water-inlet tube with water pressurization by a pump having a power system isolated from interruption by a wildfire.

21. The wildfire protection system of claim 20, wherein:

the pump is electrically powered with a motor and the power system includes a battery.

22. The wildfire protection system of claim 20, wherein:

the pump is heat-engine powered with a heat engine and the power system includes engine fuel.

23. A wildfire protection system comprising:

at least one rotating sprinkler on a plurality of four sprinkler legs;

the plurality of sprinkler legs being extended rigidly outward radially from a leg intersection and directed arcuately downward to sprinkler footings on distal ends of the sprinkler legs for positioning the rotating sprinkler vertically above a ridge of a roof with the sprinkler footings resting on slopes of the roof at distances apart for providing leverage of the sprinkler legs to resist predetermined wind pressure;

the rotating sprinkler being positioned proximate the leg intersection;

a water-inlet tube attached to a bottom of the rotating sprinkler;

the water-inlet tube being double-ended with a first water-hose connection on a first end and a second water-hose connection on a second end for optionally series use of a plurality of the rotating sprinklers with water hoses;

the rotating sprinkler including a water conveyance in fluid communication intermediate the water-inlet tube and the rotating sprinkler;

the rotating sprinkler, the sprinkler legs, the sprinkler footings, the water-inlet tube, the water-hose connection, and the water conveyance assembled having light-weight construction suitable for being lifted and placed on a rooftop;

the sprinkler legs being tubular members with thin walls for reliable positioning of the rotating sprinkler in opposition to predetermined storm pressures with predetermined material for structure of the sprinkler legs;

the leg intersections having leg-attachment sleeves for receiving top ends of the sprinkler legs; and the sprinkler footings being soft for preventing damage to rooftops.

24. The wildfire protection system of claim 23, wherein:

the leg intersections have leg attachments with rotation resistors for quick, rigid and rotation-resistant attachment of the legs to the leg intersections.

25. The wildfire protection system of claim 24, wherein:

the leg attachments include tapered sleeves having inside-peripheral taper in the leg intersections for receiving top ends of the sprinkler legs;

the tapered sleeves have lock-pin orifices for receiving lock pins;

the top ends of the sprinkler legs have lock slots for receiving the lock pins;

the lock pins are positioned in the lock-pin orifices without being extended into the lock slots for allowing insertion of the tops of the sprinkler legs into the tapered sleeves, for allowing rotation of the tops of the sprinkler legs in the tapered sleeves and for allowing removal of the tops of the sprinkler legs from the tapered sleeves; and the lock pins are extended into the lock slots for preventing the top ends of the sprinkler legs from being rotated in, loosened from and removed from the tapered sleeves selectively.

26. The wildfire protection system of claim 23, wherein:

the sprinkler footings have weight attachments which include circumferential walls for attachment of sandbags for anchoring weights.

27. The wildfire protection system of claim 23, wherein:

the sprinkler footings have water containers to contain water for anchoring weights.

28. The wildfire protection system of claim 27 and further comprising:

anchor-water conveyances intermediate the water-inlet tube and the water containers for filling the water containers simultaneously with directing water to the rotating sprinkler after being positioned on a rooftop.

29. A wildfire protection system comprising:

at least one rotating sprinkler on a plurality of sprinkler legs;

the plurality of sprinkler legs being extended rigidly outward radially from a leg intersection and directed predeterminedly downward to sprinkler footings on distal ends of the sprinkler legs for positioning the rotating sprinkler vertically above a ridge of a roof with the sprinkler footings resting on slopes of the roof at distances apart for providing leverage of the sprinkler legs to resist predetermined wind pressure;

the rotating sprinkler being positioned proximate the leg intersection; and a water-inlet tube in fluid communication with the rotating sprinkler.

30. The wildfire protection system of claim 29, wherein:

the sprinkler footings includes footing weights to anchor sprinkler legs to the rooftops.

31. The wildfire protection system of claim 30, wherein:

the sprinkler legs are predeterminedly short, the sprinkler footings are predeterminedly closely spaced and the footing weights have predetermined weight to maintain the sprinkler legs and the rotating sprinkler on the rooftop reliably for indefinite periods of time.

* * * * *